United States Patent [19]

Tomasik

[11] 3,980,264

[45] Sept. 14, 1976

[54] PAINT CAN AND ACCESSORY HOLDER

[76] Inventor: Oliver R. Tomasik, 107 Mississippi Ave., Joliet, Ill. 60433

[22] Filed: Dec. 22, 1975

[21] Appl. No.: 643,013

[52] U.S. Cl. ..... 248/210; 248/311.1; 248/110

[51] Int. Cl.[2] ..... E06C 7/14

[58] Field of Search ..... 248/210, 211, 311, 110, 248/111, 226 A, 226 R, 226 B, 238, 246

[56] References Cited

UNITED STATES PATENTS

| | | | |
|---|---|---|---|
| 1,221,658 | 4/1917 | Berry | 248/311 R |
| 2,367,256 | 1/1945 | Atkins | 248/210 |
| 3,182,943 | 5/1965 | Crossman | 248/210 |
| 3,317,171 | 5/1967 | Kramer | 248/311 R |
| 3,822,846 | 7/1974 | Jesionowski | 248/210 |
| 3,897,722 | 8/1975 | Harris | 248/311 R |

*Primary Examiner*—Robert A. Hafer
*Attorney, Agent, or Firm*—John L. Parker

[57] ABSTRACT

A paint can and accessory holder for use with a ladder is provided. The holder includes a horizontal base for supporting a paint can, a vertical member having its lower end removably secured to the base, a horizontal upper cross-arm removably secured along its mid-portion to the upper end of the vertical member, and a clamp removably secured to one end of the cross-arm and adapted to releasably grip a ladder or other fixed structural member. The base includes a support mount and tray for holding a paint can, as well as an accessory tray. The upper cross-arm is provided with wet paint brush holding and storage means generally vertically juxtaposed over the paint can holding tray so that brush drippings will fall into an open paint can held by the tray. The holder is adaptable to different size paint cans. The entire holder assembly is of the knock-down type. It may be quickly and easily assembled and disassembled as desired.

6 Claims, 3 Drawing Figures

PAINT CAN AND ACCESSORY HOLDER

DESCRIPTION OF THE INVENTION

This invention relates to a holder for a paint can and painting accessories, and more particularly concerns a knock-down type holder which is especially useful to a painter using a ladder.

As is well known, a painter working from a ladder must hold onto a paint brush or paint roller with one hand while securing and manipulating an open paint can resting on the ladder with the other hand. The paint can conventionally rests upon a ladder platform provided for that purpose. Unfortunately, a conventional ladder platform does not include means for securing the paint can against tipping or falling from the ladder. Also conventional ladders often do not include any means for holding a wet paint brush or roller, or painting accessories.

It is a principal object of the present invention to provide a paint can and accessory holder which may be removably secured to a ladder and which lends positive assurance to the painter that an open can will not be tipped or dislodged from the ladder during painting. It is thus an object of the inventon to prevent unwanted tipping or dumping of an open paint can from a ladder. A related object of the invention is to provide such a holder which will safely receive and hold any of several different size paint cans.

Another object of the invention is to provide such a holder not only for an open paint can, but for a wet paint brush or roller as well as for paint accessories such as a paint scraper or sandpaper. An allied object is to provide such a holder arrangement which guarantees that any paint dripped from a wet paint brush will fall into the open paint can rather than onto some unwanted location.

Yet another object of the invention is to provide a paint can and accessory holder which may be readily transported in compact, knock-down condition from one paint job to another, and yet which may be quickly and easily assembled for use on the job. A further object is to provide such a knock-down paint can and accessory holder which has few parts and may be securely fastened to a ladder for use in only a few seconds time. An allied object is to provide such a holder which may be quickly dismantled and removed from the ladder at the completion of the painting job, and then compactly stored in a small container such as a briefcase.

Other objects of the invention include provision of such a paint can and accessory holder which may be readily stored from a garage rafter or other fixed structural or building member, and which provides fail-proof, non-tipping security for an open paint can and painting accessories during painting operations.

Other objects and advantages of the present invention will become apparent upon reading the following detailed description and upon reference to the drawings, in which:

FIG. 2 also shows the accessory tray of FIG. 1 in an outward, extended position.

While the invention is described in connection with certain preferred embodiments, it will be understood that I do not intend to limit the invention to those embodiments. On the contrary, I intend to cover all alternatives, modifications and equivalents as may be included within the spirit and scope of the invention as defined by the appended claims.

Figure 1:
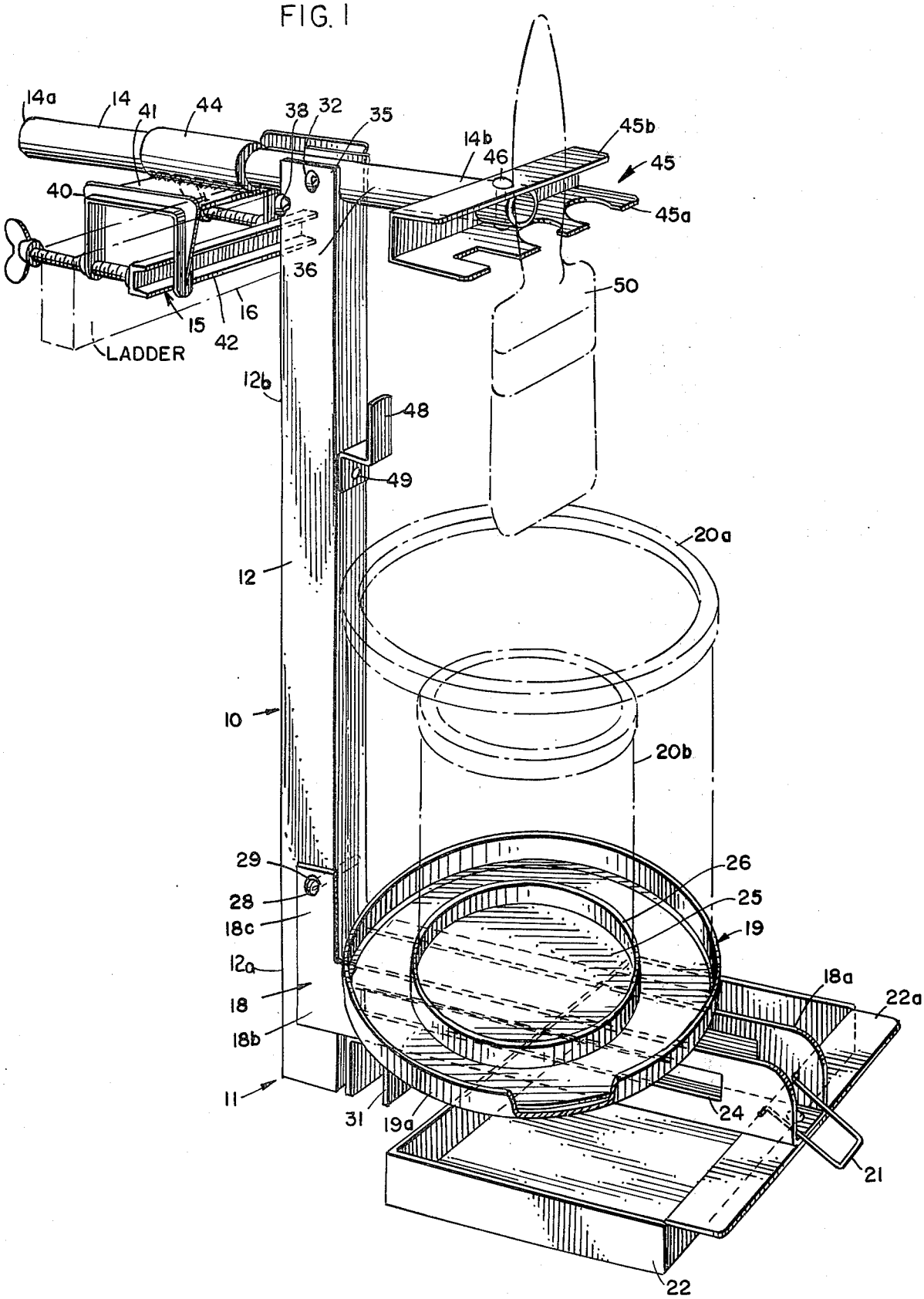
FIG. 1 is a perspective view of an illustrative paint can and accessory holder, showing the holder in assembled condition mounted on a ladder (portion shown dotted). Two illustrative sizes of paint cans are shown (dotted), and an illustrative paint brush is shown (dotted) mounted on the holder.

Turning now to the drawings, there is shown in FIG. 1 an illustrative paint can and accessory holder 10. As shown, the holder 10 includes a horizontal base 11, a vertical member 12, an upper cross-arm 14, and a ladder clamp 15, all detachably connected together as will be described. Two different sizes of paint cans and an illustrative paint brush being temporarily stored are illustrated (dotted) in FIG. 1. The holder 10 is shown secured (via the clamp 15) to a ladder portion 16 (also dotted).

As will be seen from the drawings, the base 11 includes a support mount 18 disposed generally horizontally and having fixedly secured thereon (as by welding) a generally flat circular tray 19. The tray 19 is sized and shaped to receive a gallon size paint can 20*a*, and is provided with an upturned, peripheral flange 19*a* for securely holding the bottom of the paint can. The support mount 18 is elongated and channel shaped, with the channel opening upwardly. Its ends 18*a*, 18*b*, extend beyond the tray 19. A wire hook 21 is secured to the outer end 18*a* of the support mount for facilitating hanging of the holder from a support, or for hanging a tool or the like from the support mount.

Figure 2:
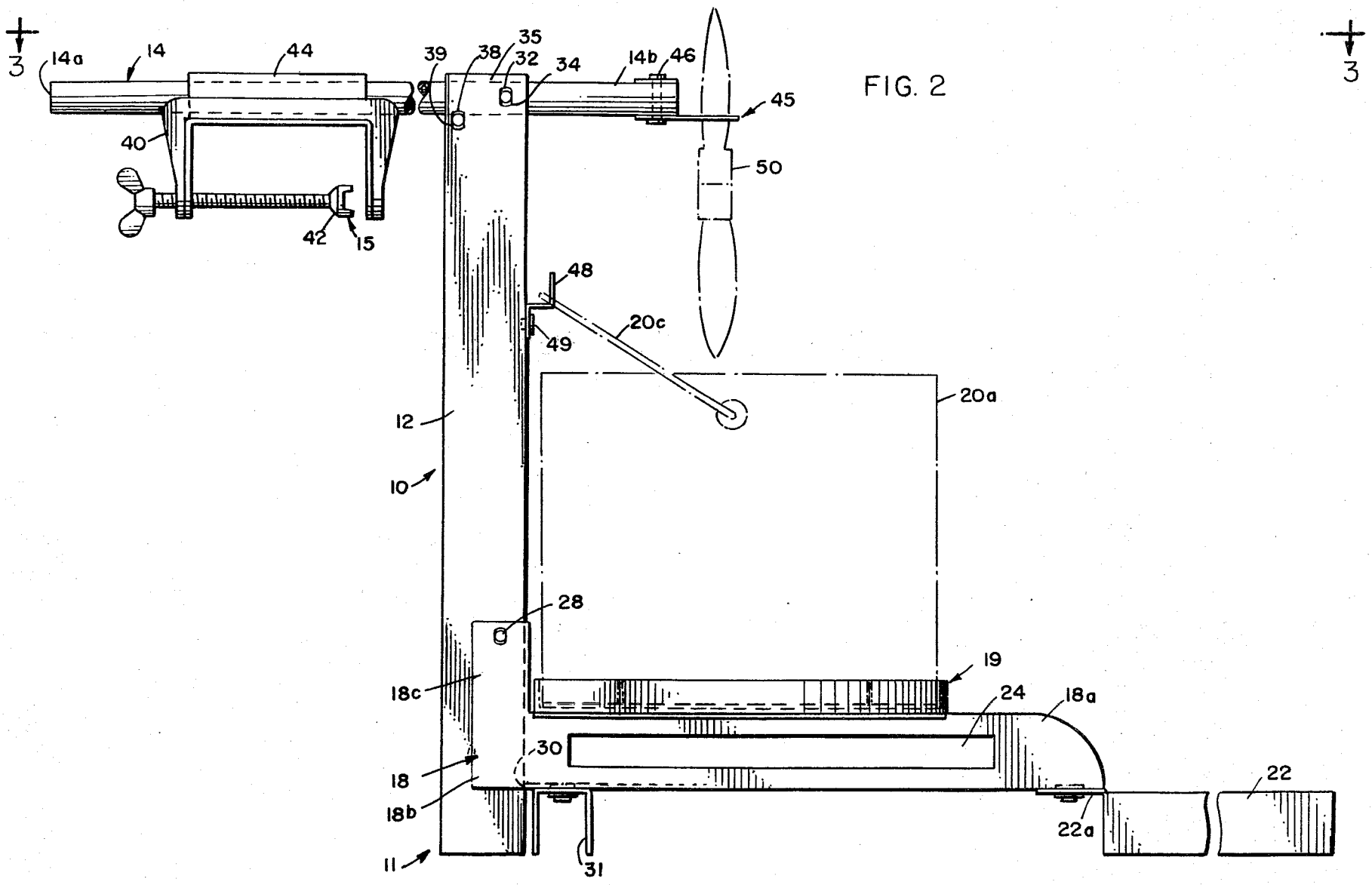
FIG. 2 is a side elevational view of the illustrative paint can and accessory holder depicted in FIG. 1, showing the holder removed from the ladder and with the paint can bail in place on a holder clip.
Figure 3:
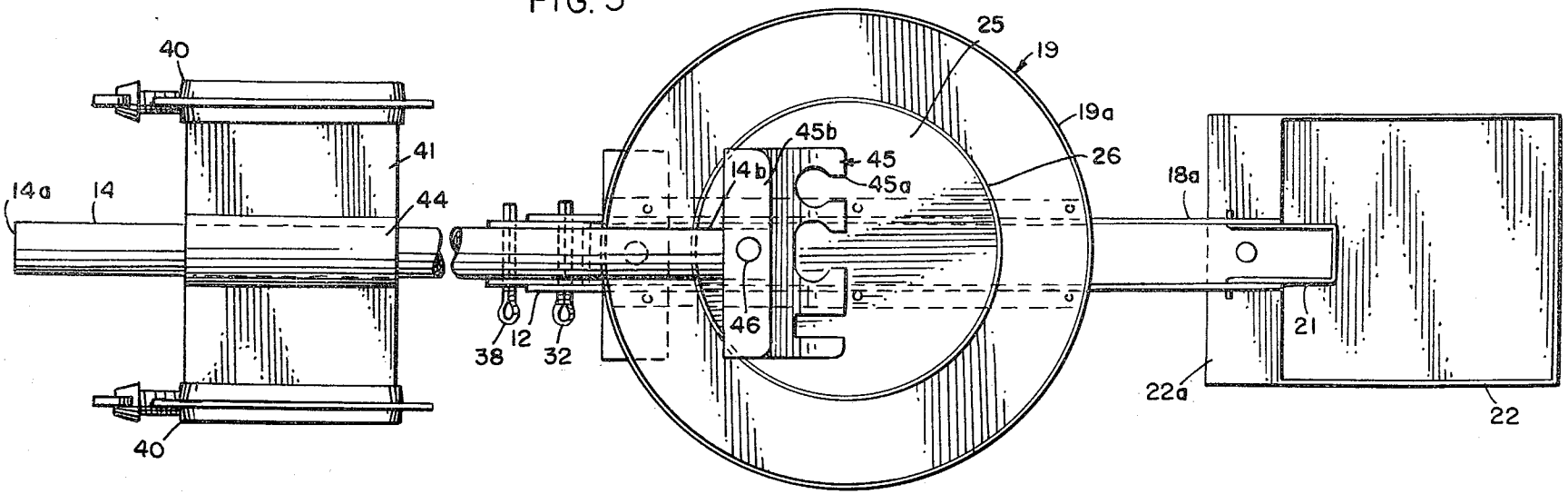
FIG. 3 is a plan view of the illustrative paint can and accessory holder shown in FIG. 2, without the paint can and brush.

One of the features of the invention resides in provision of an accessory tray 22 underlying the support mount 18 and having a lip 22*a* swingably securable to the outer end 18*a* of the mount. A fastener or rivet 24 is provided for swingably securing the lip 22*a* to the mount end 18*a*. The accessory tray 22, which is generally rectangular in shape and is of sufficient depth to carry painting accessory items, may be used to store various tools, such as sandpaper, paint scraper, screw driver, solvents and the like. By swinging (about the fastener 24) the tray 22 from the folded-up position shown in FIG. 1 to the extended position shown in FIGS. 2 and 3, the tray becomes readily accessible during painting operations.

An advantageous aspect of the invention is illustrated by provision of a slot 24 disposed axially along the support mount 18. The length of the slot 24 slightly exceeds the diameter of a gallon size paint can lid (not shown), and the slot depth just exceeds the thickness of the can lid. Thus, when the paint can has been opened for use, the painter may simply place the can lid in the slot 24 and thereby store the lid until it is time to return it to the can.

Another of the features of the invention resides in provision of an insert 25 for the paint can tray 19, which insert permits the tray to accomodate a quart size paint can 20*b* (see FIG. 1). In this instance, the insert 25 comprises a circular plate having a diameter slightly less than that of the tray 19, so that the insert may be disposed within the tray with its marginal edges closely abutting the inner periphery of the tray flange 19*a*.

For holding a smaller, quart size can 20*b*, the insert is provided with an upstanding circular ring 26 welded or otherwise firmly secured to the plate. The inner diameter of the ring 26 is chosen to slightly exceed the outer diameter of the standard quart size paint can 20*b*, so that the can base will be firmly held by the ring during use.

The insert 25 is, of course, easily removable from the tray 19, so that quart or gallon size paint cans may be used interchangeably if desired. It is within the scope of my invention to employ an insert having an even smaller diameter ring (eg. for a pint size can), or to shape the ring in a non-circular manner (eg. oval) if need be in order to accomodate a can base of non-circular shape.

For facilitating ease of assembly, disassembly and storage of the components of the holder 10, the inner end 18*b* of the support mount is bifurcated and L-shaped to define a pair of spaced apart ears 18*c*. The elongated, vertical member 12, shown with a rectangular cross-section, has its lower end 12*a* sized and shaped to fit within the ears 18*c* of the support mount, and is removably securable to the mount. Aligned openings 29 are provided through the member end 12*a*, and in the mount ears 18*c*, for insertion therethrough of easily manipulable fastening means, such as a cotter pin 28. Thus, in assembly, the mount end 18*b* of the base 11 is placed near the lower end 12*a* of the vertical member, the mount ears 18*c* are slipped over the member end 12*a* so that their respective openings 29 are aligned, and the cotter pin 28 is inserted through the openings to thereby join the base 11 and vertical member 12 together. Stop means is provided to limit swing motion of the base 11 with respect to the vertical member 12 after insertion of the cotter pin 28, so that the paint can and tray remain fixed in a horizontal position and the vertical member is disposed at a 90 degree angle with the support mount. As shown, this stop means takes the form of a shoulder 30 provided on the bottom of the support mount (see FIG. 2) and a channel shaped member 31 secured to the underside of the support mount near its bifurcated end 18*b*.

In keeping with the invention, means is provided for securing the upper end 12*b* of the vertical member to a ladder or the like. As shown, this means includes the upper cross-arm 14 and the ladder clamp 15. The illustrative cross-arm 14 is of elongated, tubular shape and is removably securable along its mid-portion to the bifurcated upper end 12*b* of the vertical member. Means for removably securing these parts together is provided in the form of a cotter pin 32 which passes through aligned openings 34 provided in the cross-arm and in a pair of spaced ears 35 defined by the bifurcated end 12*b* of the vertical member. Thus, the bifurcated end 12*b* of the member 12 forms a cradle 36 for receiving the mid-portion of the cross-arm 14. A cotter pin type stop 38 is provided for fixing the cross-arm 14 and vertical member 12 against relative rotation. This stop extends through aligned openings 39 provided in the ears 35 just beneath the cross-arm 14, to prevent rotative action between cross-arm and vertical member when the cross-arm is clamped to a ladder.

The illustrative clamping means 15 includes a pair of thumb-screw operated C-clamps 40, which are maintained in spaced apart relationship by a mounting plate 41 and clamping bar 42. The flat mounting plate 41 is fixed (as by welding) to the bodies of the C-clamps 40, and the clamping bar 42 is similarly secured across the thumb-screw operable clamping portions of the clamps 40. For mounting the clamp 15 upon the inner end 14*a* of the cross-arm, a sleeve 44 is provided on the side of the mounting plate 41 opposite the clamping bar 42. The sleeve 44 is welded or otherwise permanently secured to the mounting plate 41, and is sized to just fit over the end 14*a* of the tubular cross-arm. When the clamp sleeve 44 is in place on the cross-arm 14, the clamp 15 depends from the cross-arm end 14*a* and its clamping portions are in position to grip a rung or other portion of the ladder 16.

When the cross-arm 14 is in operable position, it is horizontally disposed and generally vertically juxtaposed over the support mount 18. The length of the cross-arm 14 is chosen such that its outer end 14*b* terminates at a location approximately over the center of the tray 19. The purpose of this arrangement is to permit mounting on the end 14*b* of the cross-arm of a paint brush holder 45 in such a position that paint droplets from a wet paint brush or the like will fall into an open paint can held by the tray 19. To this end, the holder 45 for paint brushes, rollers or the like includes a channel shaped member secured, as by a rivet 46 to the outer end 14*b* of the cross-arm. The channel shaped member has one channel wall 45*a* notched to receive several brush handles at the same time, and the other channel wall 45*b* recessed to accomodate brush handles held by the notches.

Assembly of the illustrative paint can and accessory holder may be readily accomplished by a painter on the job. The component parts of the holder 10 may be transported to the job in compact fashion in a small briefcase or the like. The painter need only join the base 11 and vertical member 12 together using the aligned openings 29 and cotter pin 28. Then, the cross-arm 14 may be joined to the top of the vertical member 12, using the aligned openings 34, cotter pin 32, and the stop pin arrangement 38, 39. Upon placing the clamp sleeve 44 over the inner end 14*a* of the cross-arm, the holder 10 is ready for use.

The painter may, while on the ground, place a paint can on the holder tray 19, with the bail 20*c* of the can resting firmly within an L-shaped clip 48 secured by a rivet 49 to the upper portion of the vertical member 12, and loosen the paint can lid. Then the painter may carry the holder and can up a ladder, clamp the holder to the ladder, remove the paint can lid and insert it into the holder slot 24. By swinging the accessory tray 22 outwardly, the painter is ready to begin work. When the painter wishes to use his accessory tools, they are close at hand in the accessory tray 22. When the painter wishes to rest, he simply places his wet brush 50 in the notched brush holder 45.

The painter can use the portion of the cross-arm adjacent the outer end 14*b* as a hand grip should he wish to change ladders or the like. The cross-arm may be gripped around the tubular portion (see 14*b*), or around the brush holder 45. The brush holder 45 is designed so that the painter's hand may be placed with the back of the hand facing inwardly toward the vertical member 12 and the fingers curled around the channel. Or the painter's hand may be placed the opposite way, with the back of the hand facing outwardly and the fingers curled around the wall 45*b* of the brush holding channel so that the ends of the fingers rest within the channel.

In some instances, the painter uses an aluminum ladder with hollow, round rungs and corresponding openings on the side of the ladder. If the size of the openings permits, the holder cross-arm 14 may be used as a support without the assistance of the clamp 15 by inserting the end 14*a* of the cross-arm into one of the openings of the ladder.

Upon completion of the painting job, disassembly of the holder 10 is achieved in reverse fashion to that described above. The holder clamp 15 may be used to store the holder, if desired, from a garage or basement ceiling rafter or wall stud or the like.

The invention may be advantageously used with wooden ladders or metal ladders. The paint can and accessory holder may be clamped on the inside or outside of the ladder. And it may be clamped on either side of the ladder, thus accommodating right or left-handed painters.

I claim as my invention:

1. A paint can and accessory holder comprising, in combination, a base for supporting a paint can, said base including a support mount disposed generally horizontally and having fixedly secured thereon a generally flat tray sized and shaped to receive a paint can, said support mount being elongated and having its ends extending beyond the tray, an accessory tray underlying said support mount and having a lip swingably securable to one end thereof, means for swingably securing together said lip of the accessory tray and said one end of the support mount, the other end of said support mount being bifurcated, an elongated, vertical member having its lower end sized and shaped to fit within said bifurcated support mount end and being removably securable thereto, stop means carried by said support mount for abutment by said lower end of the vertical member so that the vertical member is disposed at a 90 degree angle with the support mount, means for removably securing together said bifurcated support mount end and the lower end of said vertical member, an elongated upper cross-arm removably securable along its mid-portion to the upper end of said vertical member, means for removably securing together the mid-portion of said upper cross-arm to the upper end of said vertical member, said upper cross-arm being horizontally disposed and generally vertically juxtaposed over said support mount so that one end of the cross-arm terminates at a location approximately over the center of said tray, means carried by said one end of the cross-arm for holding a paint brush or the like, and clamping means removably secured to the other end of said cross-arm for releasably gripping a ladder or other fixed structural member.

2. A paint can and accessory holder as defined in claim 1 in which the bifurcated end of said support mount is L-shaped and the stop means includes a channel shaped member secured to the underside of the support mount near its bifurcated end.

3. A paint can and accessory holder as defined in claim 1 in which the means for carrying a paint brush or the like includes a channel shaped member notched to receive several brush handles at the same time.

4. A paint can and accessory holder as defined in claim 1 in which the support mount is provided with an axial slot sized to receive and store a paint can lid.

5. A paint can and accessory holder as defined in claim 1 in which the ladder clamp comprises a pair of spaced C-clamps joined by a mounting plate and clamping bar.

6. A paint can and accessory holder as defined in claim 1 in which an insert for receiving a small paint can is disposed within the generally flat tray, and a clip is provided on the upper portion of said vertical member for receiving and holding the bail of a paint can.

* * * * *